US009385476B2

(12) United States Patent
Finzer

(10) Patent No.: US 9,385,476 B2
(45) Date of Patent: Jul. 5, 2016

(54) CONNECTOR ASSEMBLY HAVING A LOCKING DEVICE WITH CONNECTION PADS

(71) Applicant: Compagnie Deutsch GmbH, Martinsried (DE)

(72) Inventor: Carlo Finzer, Kissing (DE)

(73) Assignee: COMPAGNIE DEUTSCH GMBH, Martinsried (DE)

( * ) Notice: Subject to any disclaimer, the term of this patent is extended or adjusted under 35 U.S.C. 154(b) by 108 days.

(21) Appl. No.: 14/359,526

(22) PCT Filed: Nov. 19, 2012

(86) PCT No.: PCT/EP2012/072997
§ 371 (c)(1),
(2) Date: May 20, 2014

(87) PCT Pub. No.: WO2013/076041
PCT Pub. Date: May 30, 2013

(65) Prior Publication Data

US 2014/0335717 A1 Nov. 13, 2014

(30) Foreign Application Priority Data

Nov. 21, 2011 (EP) ..... 11189976

(51) Int. Cl.

| | |
|---|---|
| ***H01R 13/514*** | (2006.01) |
| ***H01R 13/641*** | (2006.01) |
| ***H01R 13/436*** | (2006.01) |
| ***H01R 13/66*** | (2006.01) |
| ***H01R 13/717*** | (2006.01) |
| ***H01R 13/62*** | (2006.01) |

(52) U.S. Cl.
CPC ..... *H01R 13/641* (2013.01); *H01R 13/4364* (2013.01); *H01R 13/62* (2013.01); *H01R 13/6691* (2013.01); *H01R 13/7175* (2013.01)

(58) Field of Classification Search
CPC ..... H01R 13/4362; H01R 13/4223; H01R 13/7175
USPC ..... 439/752, 595, 490, 345
See application file for complete search history.

(56) References Cited

U.S. PATENT DOCUMENTS 4,714,437 A * 12/1987 Dyki ..... H01R 13/4364 439/595
5,607,327 A 3/1997 Tsuji et al.
5,860,835 A * 1/1999 Ohsumi ..... H01R 13/4364 439/595

(Continued)

OTHER PUBLICATIONS

International Search Report and Written Opinion issued by the European Patent Office, dated Jan. 9, 2013, for related International Application No. PCT/EP2012/072997; 11 pages.

(Continued)

*Primary Examiner* — Hae Moon Hyeon
(74) *Attorney, Agent, or Firm* — Faegre Baker Daniels LLP

(57) ABSTRACT

A connector (1) comprising a least a housing (10) with a least one aperture (12), at least two terminals each being inserted into one of the aperture (12) and at least one locking device (30) for insertion into an opening (11) of the housing (10) for locking at least one of the terminals in an aperture (12), permits an easy control of the connection of the terminals, if the locking device (30) comprises at least two contact pads (36), each contact pad connecting one of the at least two terminals (50), and if the locking device (30) supports a signaling circuit, being connected to the contact pads (36).

8 Claims, 6 Drawing Sheets

(56) References Cited

U.S. PATENT DOCUMENTS 6,386,916 B1 * 5/2002 Tachi ..... H01R 13/4364
439/595
6,824,428 B2 * 11/2004 Tabata ..... H01R 13/4223
439/382
7,044,788 B2 * 5/2006 Maeda ..... H01R 13/4365
439/595
2009/0023329 A1 1/2009 Mehnert et al.

OTHER PUBLICATIONS

International Preliminary Report on Patentability issued by the International Bureau of WIPO, Geneva, Switzerland, dated May 27, 2014, for International Application No. PCT/EP2012/072997; 6 pages.

* cited by examiner

CONNECTOR ASSEMBLY HAVING A LOCKING DEVICE WITH CONNECTION PADS

FIELD OF THE INVENTION

The invention relates to a connector comprising a least a housing with a least one aperture in which at least two terminals are inserted and at least one locking device. The locking device is inserted into an opening of the housing for locking at least one of the terminals in the aperture.

DESCRIPTION OF THE RELATED ART

U.S. Pat. No. 4,714,437 discloses an electrical connector for automotive applications. The connector has a housing with four tubular apertures extending axially there through. Each of the apertures has a retention abutment for engaging into an annular recess of cylindrical terminal. Opposite of each retention abutment is a finger like retention member. The flexible retention members permit inserting the terminals the tubular apertures, as they can be bent away and thereby the peripheral surface of the terminals may pass the retention abutment, until the retention abutments engages into the annular recess. The retention members exert a restoring force on the terminals, thereby locking the retention abutments in their respective annular recesses. Subsequent to the insertion of the terminals a locking device is inserted from the front side into the housing, blocking the retentions members and thereby locking the terminals in their respective positions. The connector easily can be assembled and the terminals are safely locked in the housing.

U.S. Pat. No. 5,607,327 discloses a double locking interconnector with a connector housing. A terminal is inserted form the rear side in the connector housing. The connector housing has flexible locking pieces for engaging with terminal and thereby prevent the connector from being retracted. A front holder is inserted from the front side into the connector housing. The front holder has locking protrusions engaging with into a recess of the terminal and thereby double locks the terminal in the connector housing.

US2009/0023329 A1 discloses an electrical plug connector for connecting a sensor. The electrical plug connector has an electronic circuit with a LED for visualizing the switching state of the sensor. The housing can be made of a transparent thermoplastic material to which a colour concentrate was added.

SUMMARY OF THE INVENTION

The invention is based on the observation that the analysis of malfunctions of a vehicle or a machine due to connection problems is difficult and time consuming.

The problem to be solved by the invention is to permit a simple control of the connection provided by the connector and its complementary counterpart without changing the design of the connector, i.e. downward compatibility is required.

A solution of the problem is described by the independent claim. The dependent claims relate to further improvements of the invention.

The connector comprises a housing with at least one aperture into which at least two terminals are inserted. A locking device may be inserted into an opening of the housing for locking at least one of the terminals in the aperture. The locking device comprises at least two contact pads, each contact pad connecting one of the at least two terminals. The contact pads are connected with a signaling circuit, for example by electric lines. The signaling circuit is supported by the locking device and via the pads connected with the terminals. If the terminals are correctly connected to some line, a voltage between the terminals can be detected and analyzed by the signaling means. If the voltage is within a predetermined range the signaling circuit signals "connection established", for example by powering at least one light emitting diode (LED). The locking device unifies two functions, namely to lock the terminals in the housing and to provide an information about proper connection of the connector. The design of the housing is not or only slightly affected by the signaling circuit and can thus be downward compatible.

The housing preferably comprises at least one retention member engaging with at least one of the terminals and being blocked from releasing the at least one terminal by the locking device. For example may the opening of the housing form a gap, which is complementary to at least a section for example a land of the locking device. At least the section may fill the gap and thereby block the retention member(s) such that they are prevented from releasing the engagement between the terminal(s) and the retention member(s). Thus, the locking device may be secondary locking fixing at least one primary locking device, for example the retention members, and thereby blocking at least one of the terminals. Thus a secondary locking may serve as support and/or "printed circuit board" for the signaling circuit, thereby ensuring safe attachment of the terminals to the housing and safe connection of the connection pads with the terminals. Thus, the signaling circuit may be introduced into the housing with the locking device. This permits to assemble and test the signaling circuit outside the housing.

The locking device may comprise a front plate for closing the opening of the housing, a land for locking the terminals and a central body between the front plate and the land. The central body may support the connection pads. The connection pads are preferably in the proximity of the through holes for connecting the terminals. This permits ensuring a safe connection between the connection pads and the terminals. The connection pads may e.g. be located on the terminal facing side of the central body. This can easily be manufactured and permits the locking device to exert via the connection pads a force against the terminals, pressing the terminals in an abutment of the housing and thereby connect and stabilize the terminals in their aperture(s) at the same time.

The connection pads may comprise a conducting elastomer, enhancing the connection between the terminals and the connection pads and at the same time to exert a force by the locking device against the terminals. The side of the locking device facing away from the terminals may retain the locking device against the housing. In addition or as alternative the locking device could have at least one rim at least one of its narrow sides, the rim being inserted into a complementary guide in the contour of the opening of the housing.

At least one of the connection pads may comprise a cover of a 'pliant' metal, like tin (Sn) or copper (Cu). Such pliant cover may flow, when pressed against one of the terminal and thus permit to insert the locking device until both terminals are safely connected to the pads.

At least one of the connection pads may be spring loaded, for example may the connection pad be formed by a land of a spring. Such connector may ensure a safe and simple connection of the connection pad with the respective terminal. The signaling circuit preferably comprises electrical components, which may be positioned on the land for example in a clearance between at least two retention members. This permits a very small connector with integrated signaling circuit for controlling proper connection.

The signaling circuit may e.g. comprise LEDs for indicating if the voltage between the terminals is in a predefined voltage range. For example, the signaling circuit may comprise at least one LED being connected in series with a resistor and/or a Zener diode to the connection pads and thereby to the terminals.

DESCRIPTION OF DRAWINGS

In the following the invention will be described by way of example, without limitation of the general inventive concept, on examples of embodiment with reference to the drawings.

FIG. 6 shows a locking device of the connector of FIG. 1.

DETAILED DESCRIPTION

Figure 1:
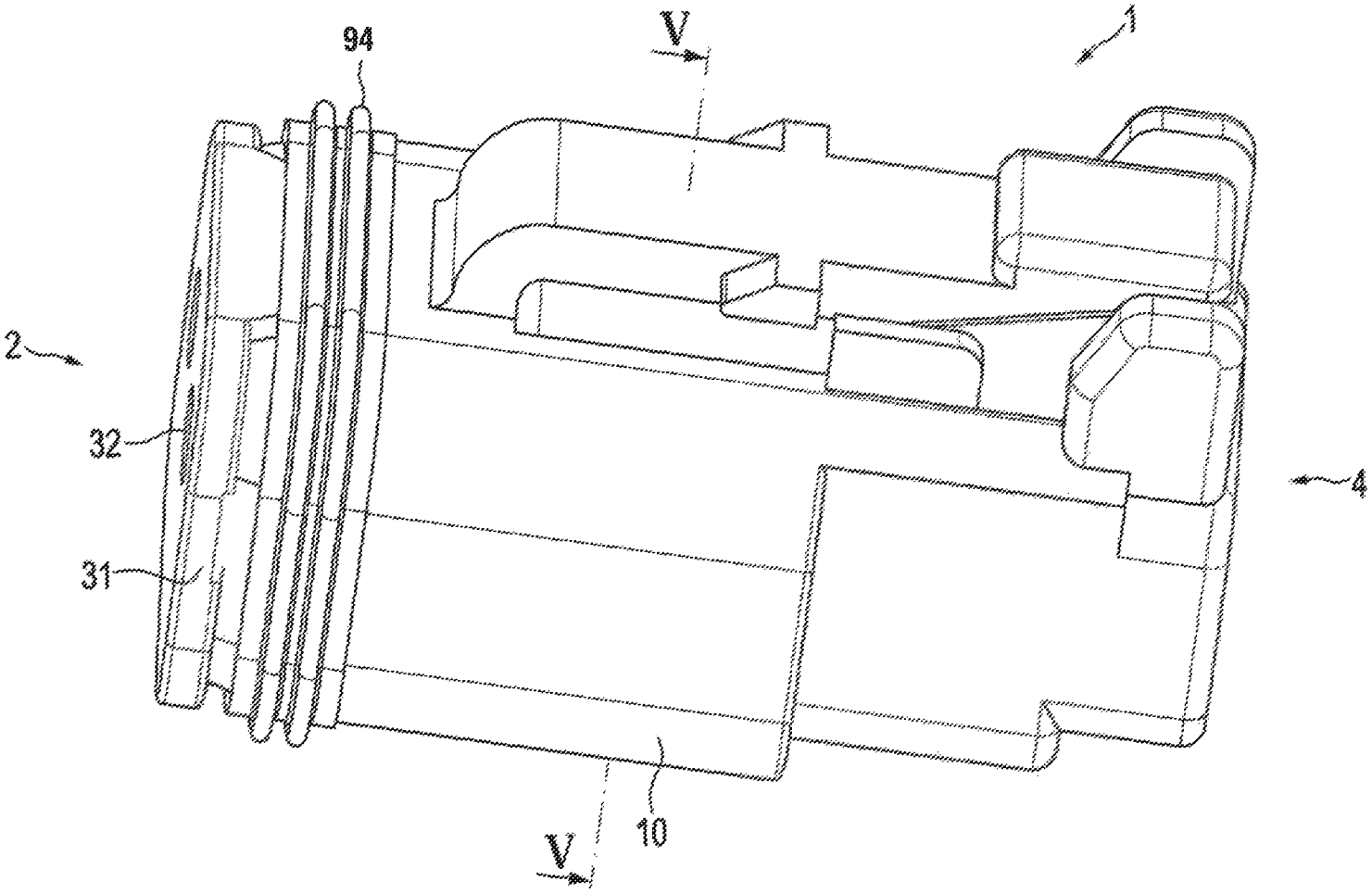
FIG. 1 shows a connector.
Figure 2:
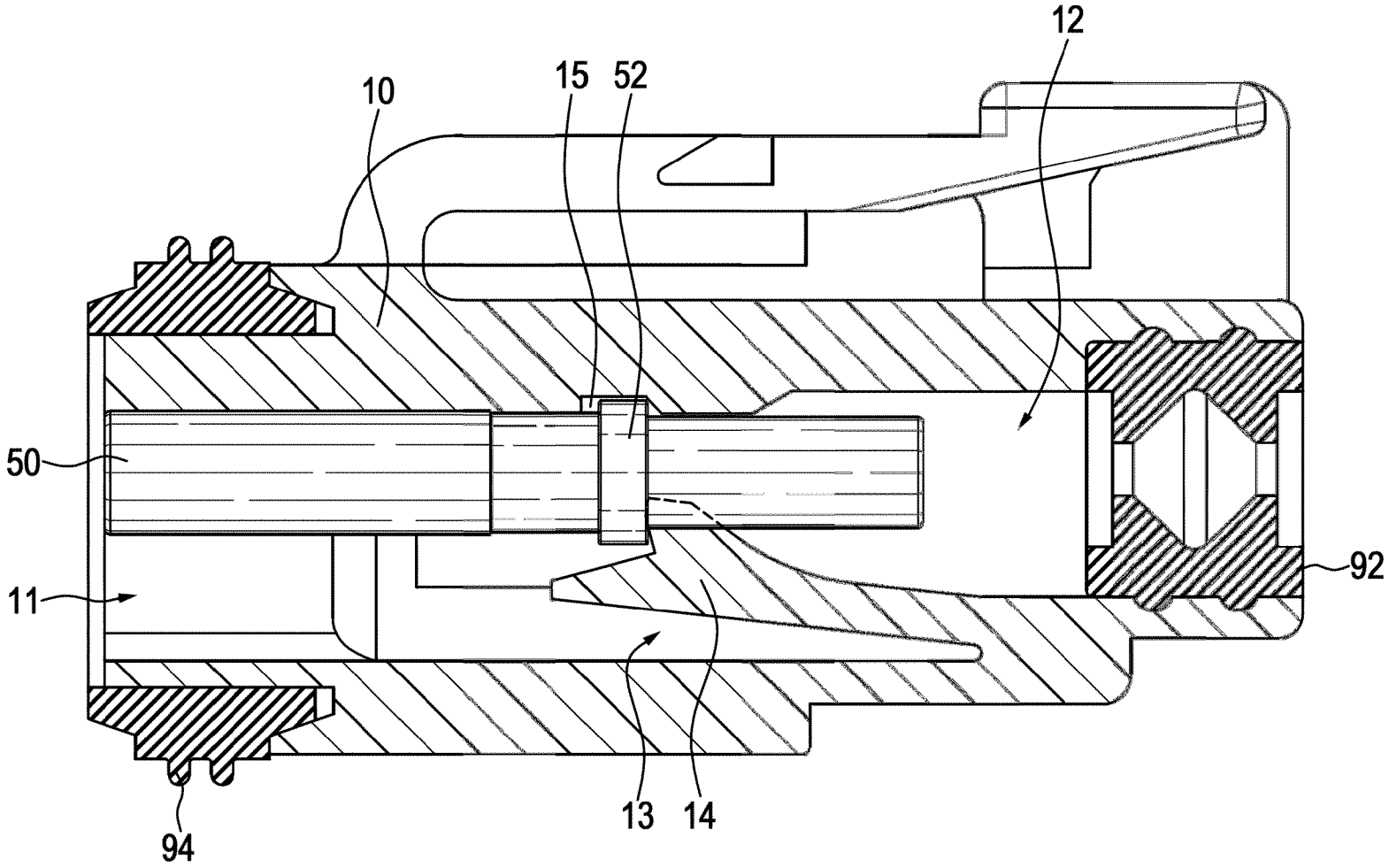
FIG. 2 shows a cross section of partially mounted connector.
Figure 4:
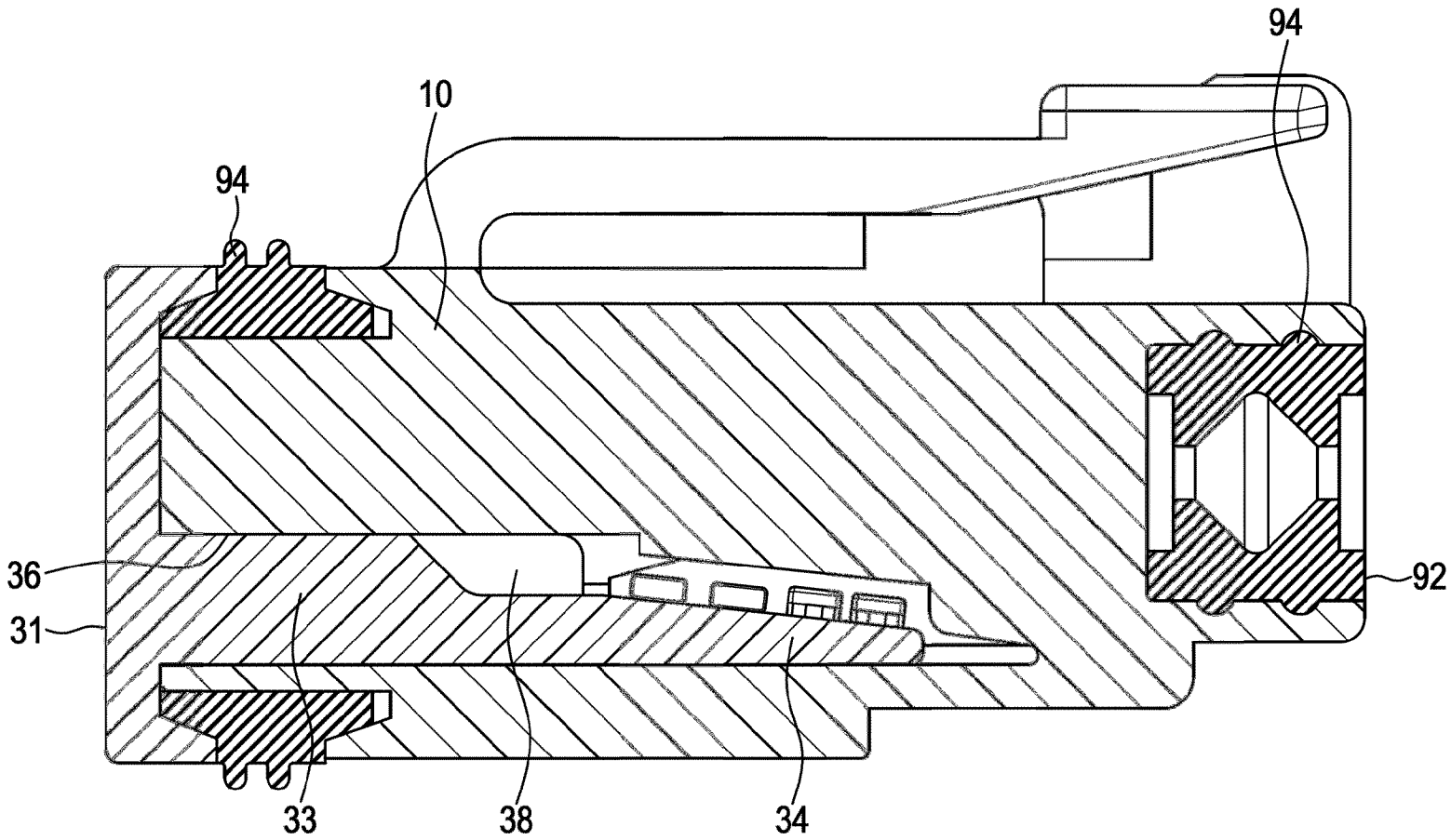
FIG. 4 shows a cross section of the connector of FIG. 1.
Figure 5:
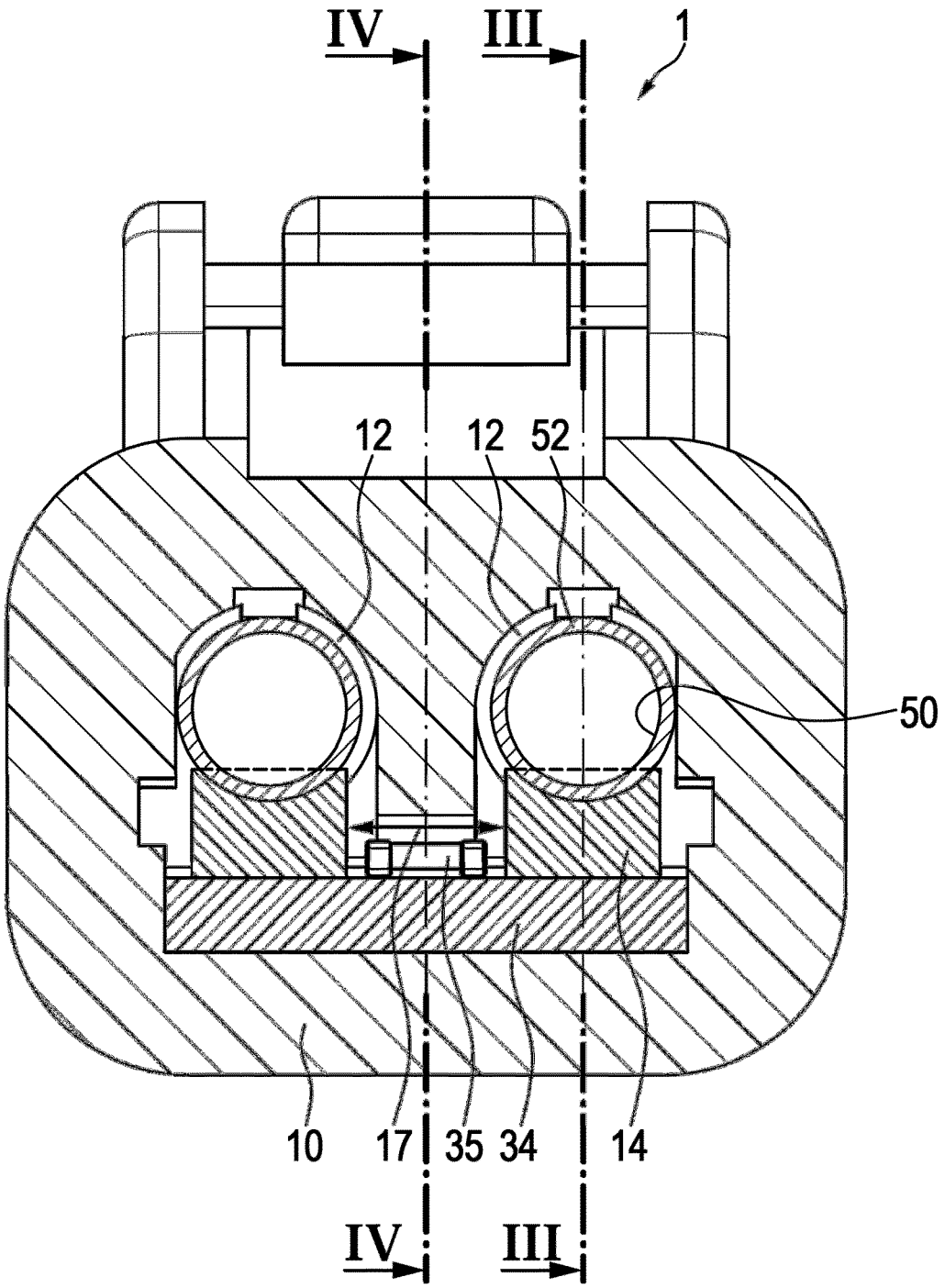

The connector 1 in FIG. 1 may have an at least partially transparent housing 10 for engagement with a complementary counterpart (not shown) of the connector 1. The connector 1 may have two axially aligned terminals 50 for receiving complementary terminal counterparts (cf. FIG. 2, showing a section of the connector in FIG. 1 along plane III, as indicated in FIG. 5). The terminals 50 may be inserted from the rear side 4 into apertures 12 of the housing 10 and may be secured against being retracted by retention members 14, serving as primary locking device. Each retention member 14 may engage with an annular thickening 52 of the respective terminal 50. The retention members 14 may be flexible and may extend finger like into the opening 11, forming a gap 13 between the wall of the housing and the retention members 14. This gap 13 permits the retention members 14 to pivot when the terminals 50 are inserted from the rear side 4 into their apertures 12 and thus to follow over the peripheral surface of the terminals 50 until they engage with the thickening 52. However, the retention members 14 may still pivot and release the terminals 50, for example if a load is exerted on the terminals 50. Such unwanted release may be avoided by inserting a wedge like locking device 30 like the one depicted in FIG. 6 into the opening 11 for example from the front side 2. The position of the locking device 30 in the opening 11 and its interaction with the housing 10 is illustrated in the FIGS. 3 and 4, showing sections of the connector of FIG. 1 along plane III and plane IV, respectively, as indicated in FIG. 5.

Figure 6:
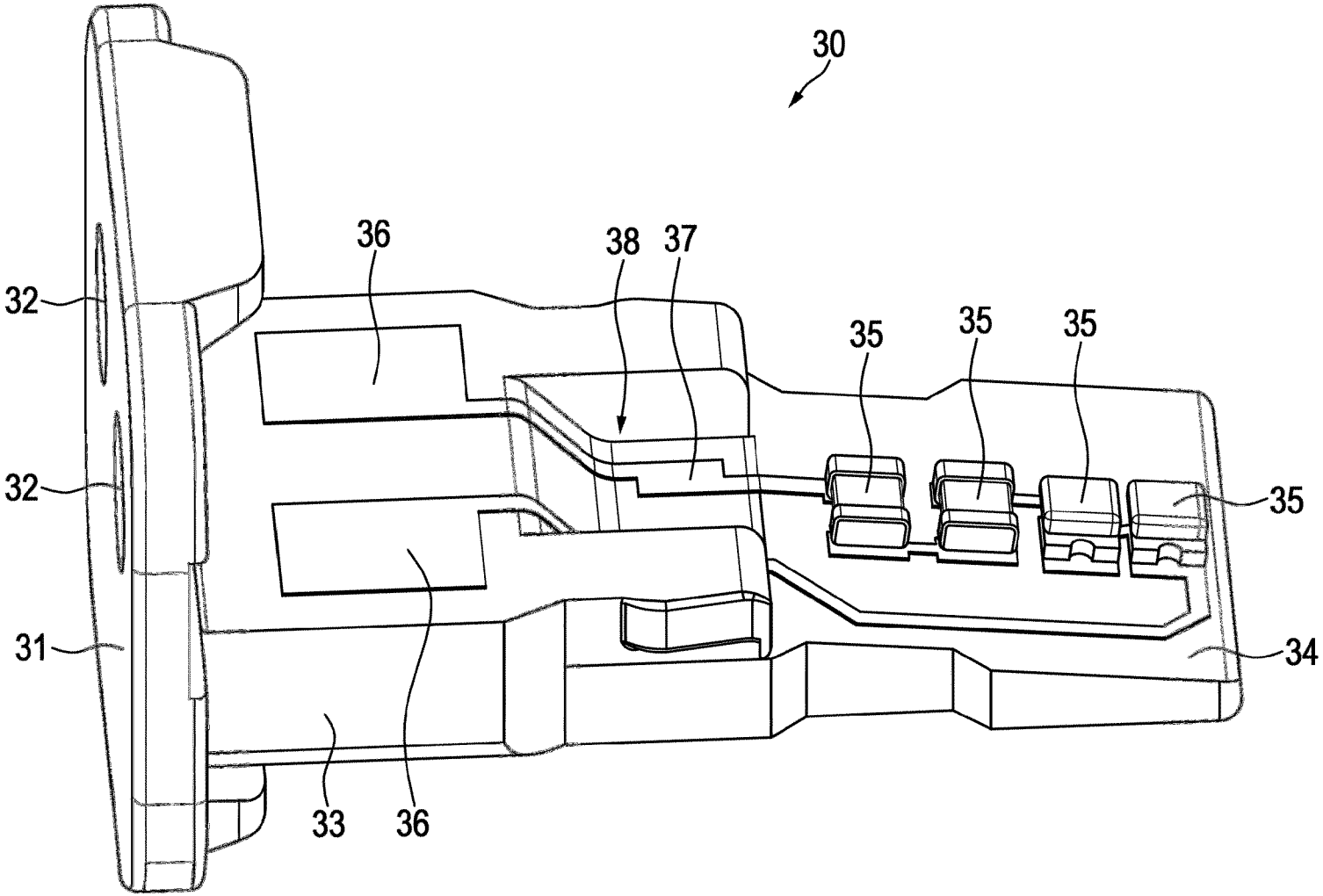
FIG. 6 shows a cross section of the connector of FIG. 1.

The locking device 30 may be an injection molded part with a front plate 31, a central body 33 and a land 34 (cf. FIG. 6). The central body 33 is arranged between the rear side of the front plate 31 and the land 34. The front plate 31 may have through holes 32 for pin like terminal members (not shown) of a complementary connector and may close the opening 11 of the housing 10. An elastic seal like gasket 94 may be inserted between the front plate 31 and the housing 10 for sealing the connection with the counterpart of the connector 1 and/or the gap between the front plate 31 and the housing 10 and at the same time between the connector 1 and its complementary counterpart. An elastic seal like gasket 92 may be inserted at the end of the housing 10 for sealing the connection with a wire.

Figure 3:
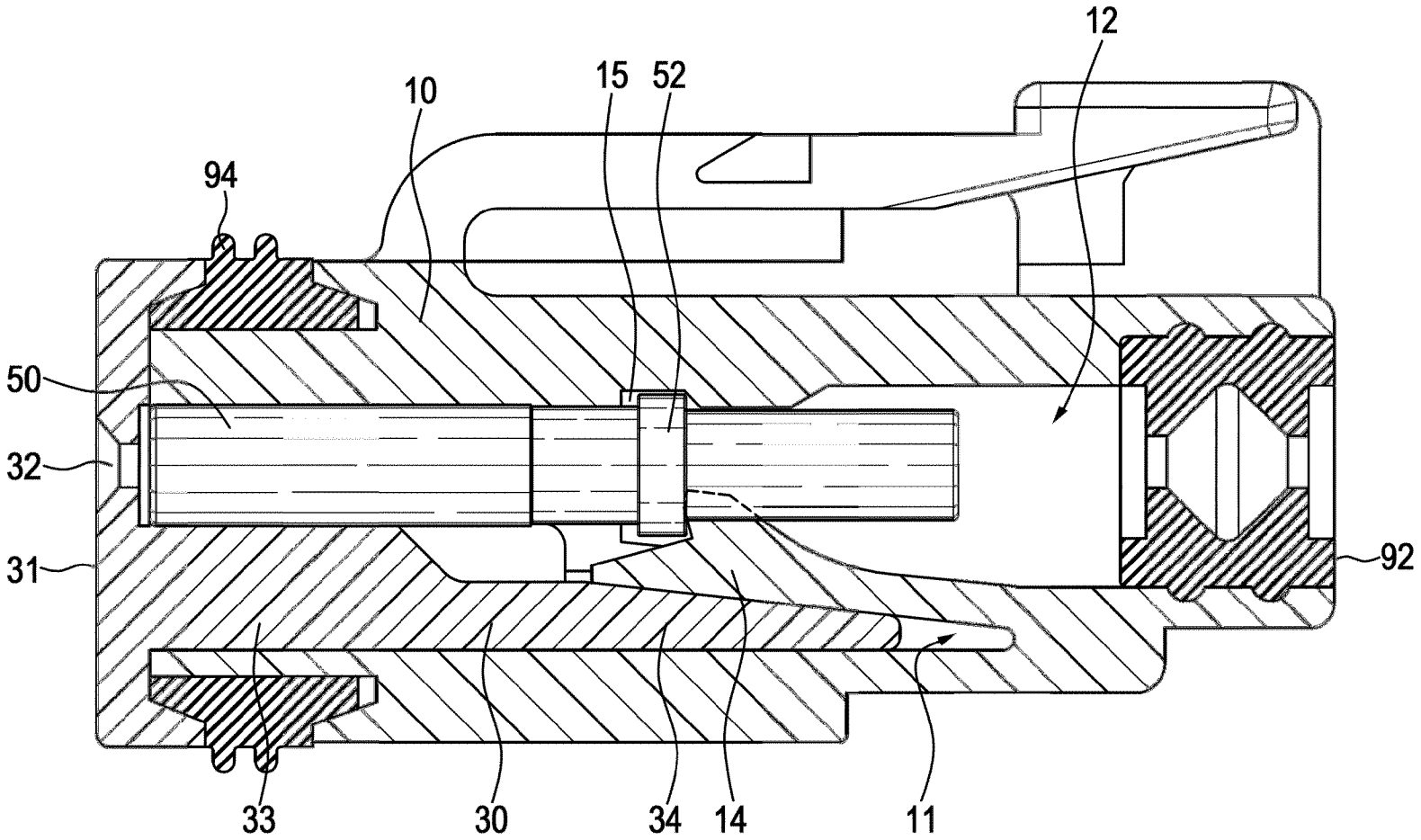
FIG. 3 shows a cross section of the connector of FIG. 1.

As illustrated in FIG. 3 (section along plane III in FIG. 5) the land 34 may have a wedge shape, fitting into the gap 13 between the retention members 14 and the wall of the opening 11, i.e. the housing 10. Thereby, the retention members 14 are inhibited from pivoting and releasing the terminals 50. Thus, the retention members 14 are blocked in engagement with the terminals 50 by the locking device 30, and more particularly by the land 34. Thus, the retention members 14 can be considered as a primary locking of the terminals 50, that are blocked by a secondary locking, namely by the locking device 30.

The central body 33 of the locking device 30 may have two connection pads 36 for connecting a signaling circuit with the terminals 50 (cf. FIG. 6). Thus, if inserted into the opening 11 of housing 10, each of the connection pads 36 may contact the peripheral surface of one of the terminals 50 (cf. FIG. 3) and thereby connect the signaling circuit with the terminals 50. The central body 33 further supports the terminals in their apertures 12. The front plate 31 blocks a movement of the terminals 50 in the direction of the front side of the opening. Thus, the terminals 50 are longitudinally blocked between the retention members 14 and the front plate 31. An additional forward stop is provided by recesses 15, into which thickenings 52 of the terminals 50 engage.

The signaling circuit comprises electrical components 35 (cf. FIGS. 4 to 6). For example the components may comprise one or more LEDs 35, which may be connected in series by electric lines 37 with at least one resistor 35 to the connection pads 36. Additional electronic components may as well be provided, for example as protective element for the at least one LED 35. A voltage between the terminals 50 is received by the connection pads 36 and forwarded via the electric lines 37 to the signaling means. If the voltage is in a predefined range, the LEDs 35 emit light, being visible through the at least partially transparent housing 10. Thus, the signaling circuit permits to visually control the proper connection of the connector 1. The signaling circuit may as well comprise a microcontroller (not shown), e.g. for controlling establishment of a data bus via the connector or other electrical components. Space for further components is provided by recess 38. The position of the electrical components 35 in the housing 11, i.e. after insertion of the locking device 30 into the opening 11, is displayed in FIG. 4. Between the retention members 14 is a clearance 17 (cf. FIG. 5, showing a section along plane V) for components like 35 of the signaling circuit.

In the depicted example is the locking device a Molded Interconnection Device, briefly referred to as MID. The locking device 30 may as well or as alternative comprise a printed circuit board e.g. for carrying at least the signaling circuit. The printed circuit board may be inserted into a recess of wedge.

LIST OF REFERENCE NUMERALS

1 connector
2 front side/facing side
4 rear side
10 housing
11 opening
12 aperture
13 gap
14 retention member
15 recess
16 extension of opening
17 clearance
30 locking device
31 front plate

32 through hole
33 central body
34 land
35 components of signaling means
36 connection pads
37 electric line
38 recess
50 terminal
52 annular thickening
92 gasket
94 gasket

The invention claimed is:

1. A connector, comprising:

a housing with at least two apertures;

at least two terminals each being inserted into one of the apertures and at least one locking device, the locking device being inserted into an opening of the housing for locking at least one of the terminals in the aperture;

the locking device comprising at least two connection pads, each connection pad connecting one of the at least two terminals; and the locking device supports a signaling circuit, being connected to the connection pads.

2. The connector of claim 1, wherein the housing is at least partially transparent and in that the signaling circuit comprises at least one LED, being powered if the voltage between the terminals is within a predefined range.

3. The connector of claim 1, wherein the housing comprises at least one retention member engaging with at least one of the terminals and being blocked from releasing the terminal by the locking device.

4. The connector of claim 1, wherein the locking device comprises a front plate for closing the opening of the housing, a land for locking the terminals and a central body between the front plate and the land, the central body supporting the connection pads.

5. The connector of claim 4, wherein components of the signaling circuit are positioned on the land between at least two retention members.

6. The connector of claim 4, wherein the connection pads are located on a terminal facing side of the central body.

7. The connector of claim 1, wherein the connection pads comprise a conducting elastomer.

8. The connector of claim 1, wherein the locking device is a secondary locking for blocking the at least one terminal in the housing by fixing a primary locking device.

* * * * *